US009307878B2

(12) United States Patent
Kosovac

(10) Patent No.: US 9,307,878 B2
(45) Date of Patent: Apr. 12, 2016

(54) TOILET SEAT EXHAUST SYSTEM

(71) Applicant: Aleksandar Kosovac, Schiller Park, IL (US)

(72) Inventor: Aleksandar Kosovac, Schiller Park, IL (US)

( * ) Notice: Subject to any disclaimer, the term of this patent is extended or adjusted under 35 U.S.C. 154(b) by 157 days.

(21) Appl. No.: 14/086,074

(22) Filed: Nov. 21, 2013

(65) Prior Publication Data

US 2015/0052673 A1 Feb. 26, 2015

Related U.S. Application Data

(63) Continuation-in-part of application No. 13/975,289, filed on Aug. 24, 2013, now abandoned.

(51) Int. Cl.

| | |
|---|---|
| ***E03D 9/05*** | (2006.01) |
| ***A47K 13/30*** | (2006.01) |
| ***E03D 9/052*** | (2006.01) |

(52) U.S. Cl.

CPC ..... *A47K 13/307* (2013.01); *E03D 9/05* (2013.01); *E03D 9/052* (2013.01)

(58) Field of Classification Search

CPC ..... E03D 9/052

USPC ..... 4/300–442

See application file for complete search history.

(56) References Cited

U.S. PATENT DOCUMENTS

| | | | | | |
|---|---|---|---|---|---|
| 962,490 | A * | 6/1910 | Bruder | E03D 9/052 | 16/86 A |
| 1,972,076 | A * | 9/1934 | Cross | A47K 13/307 | 4/217 |
| 2,146,982 | A * | 2/1939 | Perreault | E03D 9/04 | 4/217 |
| 2,309,885 | A * | 2/1943 | Carman | E03D 9/007 | 219/217 |
| 3,534,415 | A * | 10/1970 | Huffman | E03D 9/052 | 4/213 |
| 3,900,902 | A * | 8/1975 | Jarosinski | E03D 9/08 | 4/444 |
| 4,094,023 | A * | 6/1978 | Smith | E03D 9/052 | 285/9.1 |
| 4,103,370 | A * | 8/1978 | Arnold | E03D 9/052 | 4/213 |
| 4,375,704 | A * | 3/1983 | Smith | E03D 9/052 | 4/213 |
| 5,016,294 | A * | 5/1991 | Canovas | E03D 9/052 | 4/209 R |
| 5,590,423 | A * | 1/1997 | Boykin | E03D 9/05 | 4/213 |
| 5,996,131 | A * | 12/1999 | Vallair | E03D 9/05 | 4/209 R |
| 6,298,500 | B1 * | 10/2001 | Sollami | A47K 13/307 | 4/217 |
| 7,103,925 | B2 * | 9/2006 | Toth | E03D 9/05 | 4/213 |

* cited by examiner

*Primary Examiner* — Lori Baker

(74) *Attorney, Agent, or Firm* — Depeng Bi; Law Offices of Konrad Sherinian, LLC

(57) ABSTRACT

The toilet has a water tank, a base and a seat operatively coupled to the base. The seat includes a perforated tunnel extending along the circumference of an inner edge of the seat. The tunnel includes a channel, a wall surrounding the channel, and a set of apertures extending through the full thickness of the wall. The toilet also includes a connector channel connected to the channel of the tunnel.

13 Claims, 9 Drawing Sheets

TOILET SEAT EXHAUST SYSTEM

CROSS-REFERENCE TO RELATED APPLICATIONS

This application is a continuation-in-part of U.S. patent application Ser. No. 13/975,289, entitled "TOILET SEAT EXHAUST SYSTEM," filed Aug. 24, 2013, which is hereby incorporated by reference in its entirety.

FIELD OF THE DISCLOSURE

The present disclosure generally relates to toilets. More particularly, the present disclosure relates to a toilet seat exhaust system.

DESCRIPTION OF BACKGROUND

A toilet is a sanitation device used for the disposal of human excrement and urine (collectively referred to herein as human waste or waste). Flush toilets are the most commonly used toilets in the world. A flush toilet is connected to either a septic tank or a sewerage pipe system. The flushed water and waste from multiple toilets are piped in larger pipes to a distant sewage treatment plant. A toilet is often installed and operates in a small room (also referred to herein as a bathroom, powder room, lavatory or toilet room).

When waste is released or discharged into a toilet, gas with unpleasant and undesirable smell is released from the waste. The unpleasant smell quickly spreads throughout the entire space of the toilet room. The gas also spreads out into the space outside of the toilet room. For example, where a living room and a family room within a single family house are next to a powder room, the waste gas often outspreads into the living room and the family room.

The conventional solution to remove the waste gas from the toilet room is to install a toilet room exhaust fan in the ceiling of the toilet room. The toilet room exhaust fan is manually or automatically turned on when a person enters the toilet room. Oftentimes, the toilet room exhaust fan is turned on (meaning activated) when a light in the toilet room is turned on. The conventional solution forces the waste gas to travel upward to the ceiling before it is sucked into the toilet room exhaust fan. The unpleasant waste gas is thus not removed quickly. Moreover, the unpleasant gas is breathed and smelled by the toilet user.

Accordingly, there is a need for a new type of device and system for quickly remove the waste gas from the toilet room.

OBJECTS OF THE DISCLOSED SYSTEM, METHOD, AND APPARATUS

Accordingly, it is an object of this disclosure to provide an improved toilet.

Another object of this disclosure is to provide an improved toilet incorporating a toilet seat exhaust system.

Another object of this disclosure is to provide a toilet seat exhaust system to be used with an existing toilet.

Another object of this disclosure is to provide a toilet seat exhaust system incorporating a sensor to automatically turn on the toilet seat exhaust system.

Another object of this disclosure is to provide a toilet seat exhaust system that quickly removes human waste gas from a toilet room.

Other advantages of this disclosure will be clear to a person of ordinary skill in the art. It should be understood, however, that a system or method could practice the disclosure while not achieving all of the enumerated advantages, and that the protected disclosure is defined by the claims.

SUMMARY OF THE DISCLOSURE

Generally speaking, pursuant to the various embodiments, the present disclosure provides an improved toilet. In accordance with the present teachings, the toilet includes a base, and a seat operatively coupled to the base. The toilet further includes a perforated tunnel extending along the circumference of an inner edge of the seat. The tunnel includes a first channel, a wall surrounding the first channel, and a set of apertures extending through the full thickness of the wall and connecting to the first channel. Additionally, the toilet includes a connector channel connected to the first channel.

Further in accordance with the present teachings is a toilet seat exhaust system incorporated with a toilet. The toilet has a base and a seat operatively coupled to the base. The toilet seat exhaust system includes a perforated tunnel adapted to be affixed to the down side of the seat of along the circumference of an inner edge of the seat. The tunnel includes a first channel, a wall surrounding the first channel, and a set of apertures extending through the full thickness of the wall and connecting to the first channel. The toilet seat exhaust system further includes a connector having a connector channel that is connected to the first channel.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

A person of ordinary skills in the art will appreciate that elements of the figures above are illustrated for simplicity and clarity, and are not necessarily drew to scale. The dimensions of some elements in the figures may have been exaggerated relative to other elements to help understanding of the present teachings. Furthermore, a particular order in which certain steps, actions, events and/or processes are described or illustrated may not be actually required. A person of ordinary skills in the art will appreciate that, for the purpose of simplicity and clarity of illustration, some commonly known and well-understood elements that are useful and/or necessary in a commercially feasible embodiment may not be depicted in order to provide a clear view of various embodiments in accordance with the present teachings.

DETAILED DESCRIPTION

Figure 1:
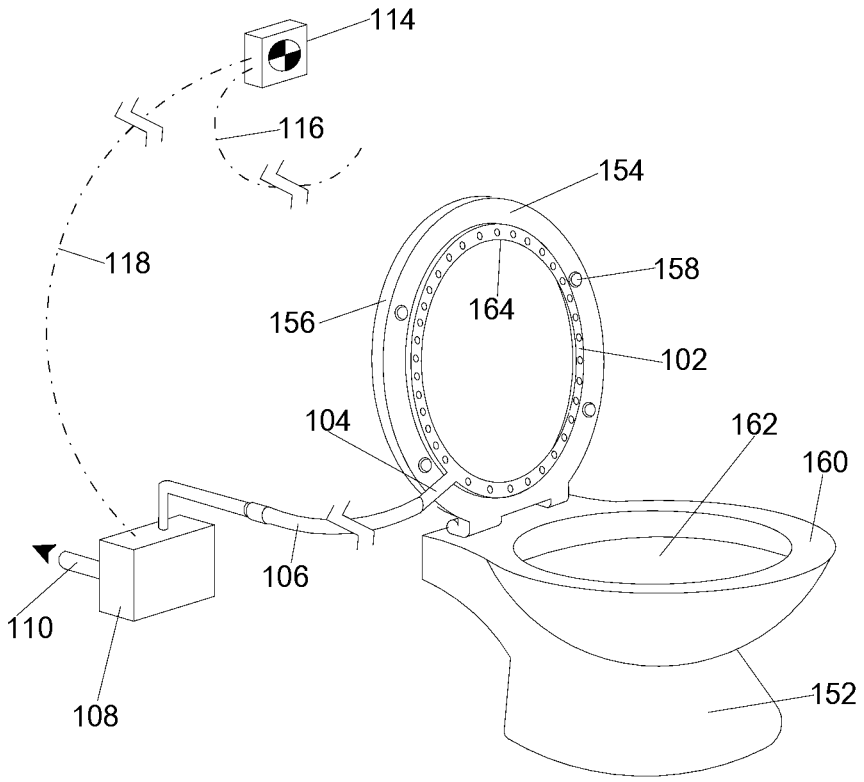
FIG. 1 is a perspective view of an improved toilet incorporating a toilet seat exhaust system in accordance with this disclosure.

This disclosure addresses a toilet seat exhaust system and an improved toilet incorporating the toilet seat exhaust system. Turning to the Figures and to FIG. 1 in particular, an improved toilet 100 is depicted in perspective. The toilet 100 includes a base 152 having a toilet bowl, a seat 154, a cover 156 and a water tank (not shown). The cover 156 and the seat 154 are pivotally mounted to the base 152 via a hinge. The hinge is attached to the base via two seat bolts (not shown). It thus can be said that the seat 154 is operatively coupled to the base 152. The seat 154 includes a set (meaning one or more) of support feet 158. When the seat 154 is in use and rests on a top surface 160 of the base 152, the supporting feet 158 engage and make contact with the top surface 160. Accordingly, a space between the seat 154 and the base 152 is formed.

The toilet 100 is connected to a water supply, such as a water pipe inside a family house, through a water supply assembly (not shown). In one implementation, the water supply assembly includes a water supply line, a compression nut, a compression ring, a stop valve, an escutcheon, and a copper supply line connected to the main water supply pipe system. The water tank stores water to provide water supply to the bowl of the base 152 for the purpose of flushing human waste into a main sewerage pipe system. In one implementation, the water tank includes a cover, a water container, a flush lever and handle, a ballcock, a flapper tank ball, a flush valve, a float ball, tank lift wires, a flapper chain, etc. The toilet base 152 is affixed a floor or ground, and coupled and connected to the main sewerage pipe system using a wax ring, a closet flange, a closet bolt slot, a soil pipe and a closet bend.

The toilet 100 further incorporates a toilet seat exhaust system. The toilet seat exhaust system includes a perforated oval tunnel 102 that is attached to or integrated with the seat 154, a flexible exhaust hose 106, a connector 104 connecting the tunnel 102 and the hose 106, a motion sensor 114, and an exhaust motor 108. The exhaust motor 108 connects to the hose 106, the sensor 114 through electrical wires 118, a main ventilation outlet (not shown) and an electricity outlet (not shown). The sensor 114 connects to a power source through electrical wires 116. In one implementation, the sensor 114 provides power to the motor 108. Alternatively, the motor 108 connects to a power source using separate electrical wires (not shown). The motor 108 and wires 116,118 are disposed behind a wall of the toilet room. Alternatively, the motor 108 is attached to the wall.

In one embodiment, the tunnel 102 and the connector 104 are made of the same material (such as plastics or wood) as the seat 154. The tunnel 102 is positioned to the down side of the seat 154. Additionally, the tunnel 102 is located inside an inner edge 164 of the seat 154. The tunnel 102 extends along the full circumference of the inner edge 164 of the seat 154. In a further implementation, the tunnel 102 extends substantially in parallel to the circumference of the inner edge 164 of the seat 154. Alternatively, the tunnel 102 extends along a portion (such as the left side) of the full circumference of the inner edge 164 of the seat 154. In each implementation above, it is said herein that the tunnel 102 extends along the circumference of the inner edge 164 of the seat 154. In one implementation, the tunnel 102 is ¼"×½" (meaning a quarter inch high and a half inch wide). Vertically, the circumference of the tunnel 102 is within the circumference of the opening 162 of the base 152. The tunnel 102 may and may not, depending on specific embodiments, extend downward beyond a top surface 160 of the base 152.

Figure 3:
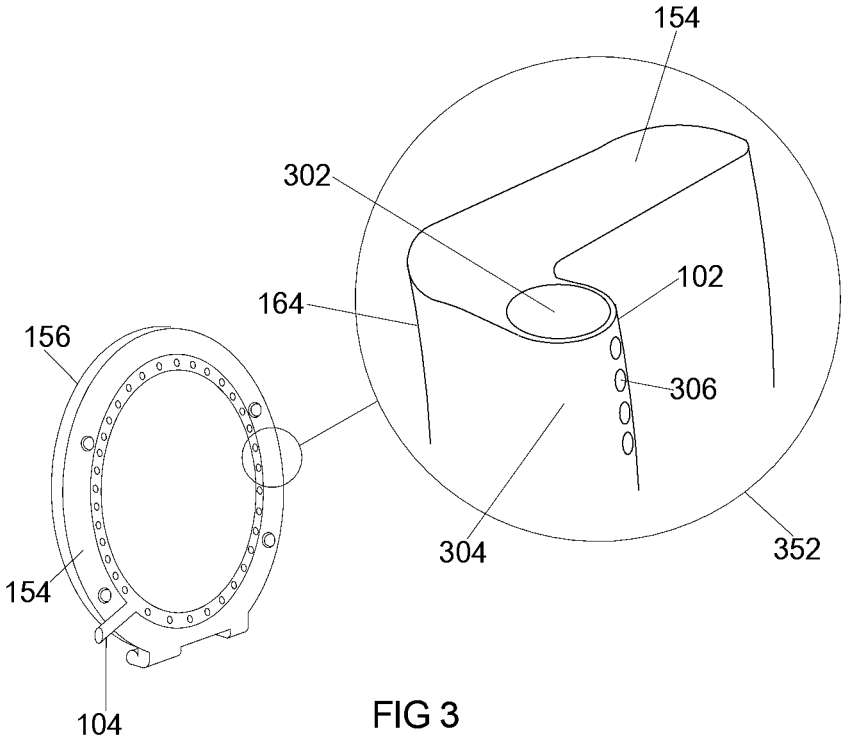
FIG. 3 is an exploded view of a toilet seat exhaust system in accordance with this disclosure.
Figure 4:
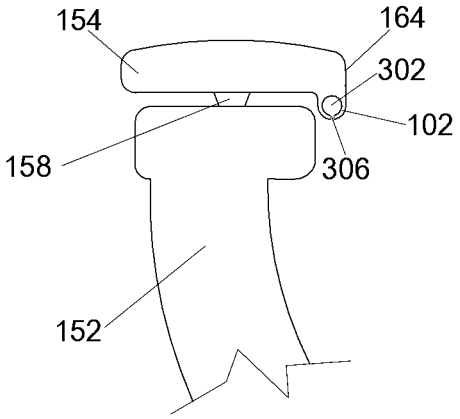
FIG. 4 is a partial cross-sectional view of an improved toilet with a toilet seat exhaust system in accordance with this disclosure.

An exploded view of the tunnel 102 is further illustrated by reference to FIG. 3. Referring to FIG. 3, a small portion of the perforated tunnel 102 is shown at 352. The tunnel 102 includes an open channel 302, a tunnel wall 304 surrounding the channel 302, and a set of apertures 306 extending along the full thickness of the lower portion of the tunnel wall 304. The apertures 306 can be made in different sizes and shapes. In one implementation, the apertures 306 are distributed on the bottom of the wall 304. Alternatively, some of the apertures 306 are positioned on one side of the wall 304. A cross-sectional view of the tunnel 102 is illustrated in FIG. 4. The tunnel wall 304 extends downward from the bottom surface of the seat 154. The channel 302 and the wall 304 can be constructed in various cross-sectional shapes. For example, the cross-sectional shape of the channel 302 is substantially circular or oval. Similarly, the cross-sectional shape of the tunnel wall 304 is a partially circular or oval.

Figure 7:
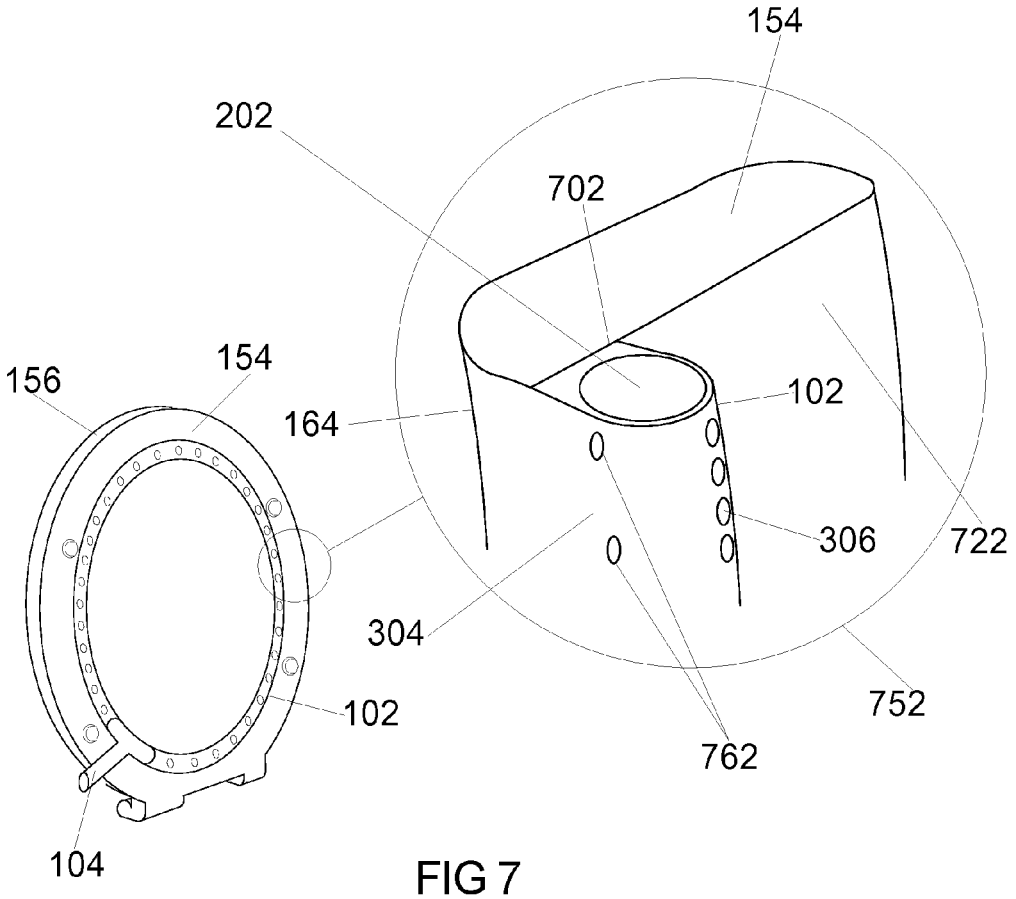
FIG. 7 is an exploded view of a toilet seat exhaust system in accordance with this disclosure.

The channel 302 may and may not, depending on specific implementations, extend upward beyond the bottom surface of the seat 154. In other words, a geometric plane containing the bottom surface of the seat 154 may be above the channel 302 or tangent to the channel 302. Alternatively, the plane intersects the channel 302. A partial exploded view of such a tunnel 102 is illustrated by reference to FIG. 7. Turning now to FIG. 7, the partial exploded view of the tunnel 102 is indicated at 752. The top surface 702 of the tunnel 102 merges with or is adjacent to a bottom surface 722 of the seat 154. In a further implementation, additional apertures are placed on the wall 304 such that they face inward toward a center of the inner opening of the seat 154. In other words, some apertures are positioned on the bottom surface of the tunnel wall 304, while other apertures are positioned on a side surface of the tunnel wall 304. As used herein, the apertures incorporated in the wall 304 are collectively referred to as a set of apertures, the apertures positioned on the side surface of the wall 304 are collectively referred to as a first subset of the set of apertures, while the apertures positioned on the bottom surface of the wall 304 are collectively referred to as a second subset of the set of apertures. The first subset of the set of apertures is indicated at 762, while the second subset of the set of apertures is indicated at 306.

The tunnel 102 as shown in either FIG. 3 or FIG. 7 forms an integral part of the seat 154. In other words, the tunnel 102 is a built-in tunnel. Alternatively, the tunnel 102 is attached to the bottom of the seat 154 as an add-on tunnel. Such an implementation can be illustrated by reference to FIG. 7 as well. In this case, the top surface 702 of the tunnel 102 is flat, and applied with a layer of glue (such as Cement for Plastic glue). To affix the tunnel 102 to the seat 145, one first aligns the tunnel 102 with the inner edge 164 of the bottom surface 722 of the seat 154 before he presses the tunnel 102 against the seat 154. Proper pressure needs to be applied. Moreover, the glue needs to dry for certain amount of time. The connector 104 is an integral part of the add-on tunnel 102. In one implementation, the connector 104 has a flat top surface. The top surface of the connector 104 is also applied with a layer of glue for affixing the connector 104 to the seat 154. Alternatively, the connector 104 is attached to the tunnel and/or the bottom surface 722 of the seat 154.

Figure 8:
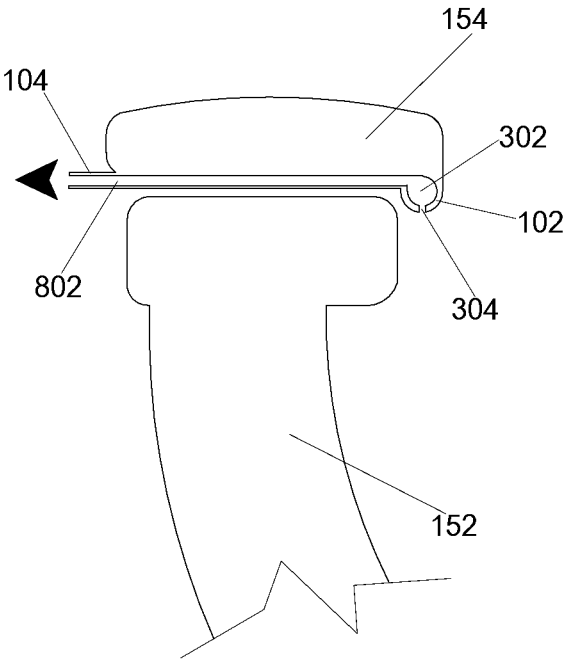
FIG. 8 is a partial cross-sectional view of an improved toilet with a toilet seat exhaust system in accordance with this disclosure.
Figure 9:
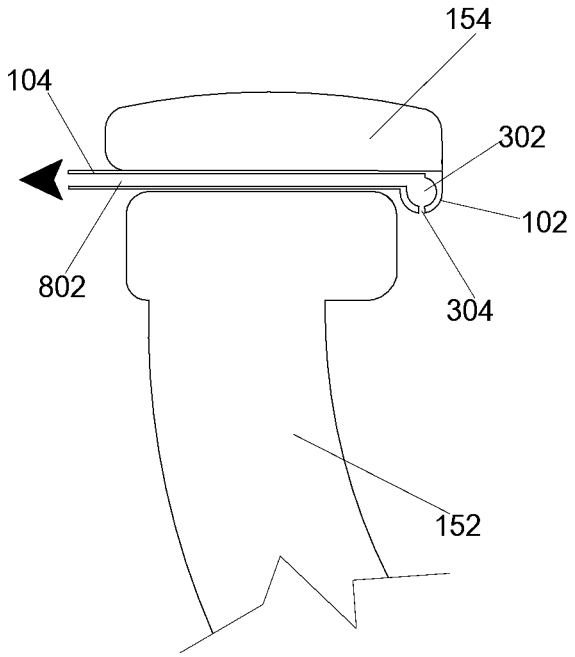
FIG. 9 is a partial cross-sectional view of an improved toilet with a toilet seat exhaust system in accordance with this disclosure.

Turning back to FIG. 1, the connector 104 has an empty center (i.e., a channel) that extends through the full length of the connector 104. The channel of the connector 104 further connects with the channel 302. Accordingly, air and waste gas (collectively referred to herein as air) can flow from the channel 302 into the channel of the connector 104. The channel of the connector 104 is further illustrated by reference to FIGS. 8 and 9. Turning first to FIG. 8, a partial cross-sectional view of the toilet 100 along the connector 104 is shown. The channel of the connector 104 is indicated at 802. The channel 802 is also referred to herein as a connector channel. The connector channel 802 extends through partial width of the seat 154 such that the connector channel 802 connects with the channel 302. The connector channel 802 thus functions as a conduit that allows air to flow from the channel 302 into the exhaust hose 106. It should be noted that air flows into the channel 302 through the apertures 304. FIG. 9 illustrates a different partial cross-sectional view of the toilet 100 along the connector 104.

In one implementation, the exhaust hose 106 is a rubber hose and ½" in diameter. One end of the rubber hose 106 is stretched to receive a portion of the connector 104 that extends outward from the seat 154, while the other end is stretched to receive a different connector extending outward from the motor 108. Accordingly, the hose 106 is said to be connected to the connector channel. Alternatively, the connector 104 does not extend beyond the surface of the seat 154. In such a case, the connector 104 is an aperture (i.e., the channel of the connector 104) into the seat 154 and connects to the channel 302. The exhaust hose 106 is then connected to the tunnel 102 by being inserted into the aperture. In this case, the aperture is said to be a connector channel; and the hose 106 is said to be connected to the connector channel.

Figure 2:
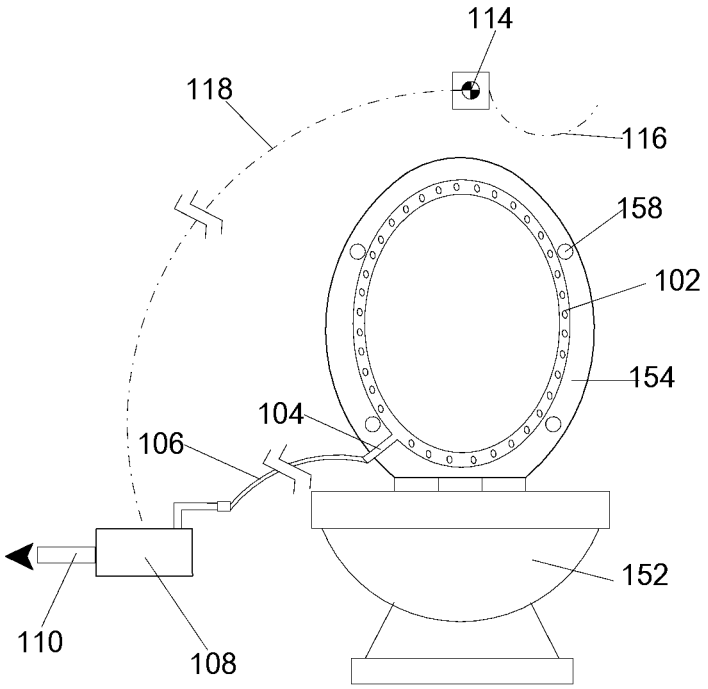
FIG. 2 is a front view of an improved toilet with a toilet seat exhaust system in accordance with this disclosure.
Figure 5:
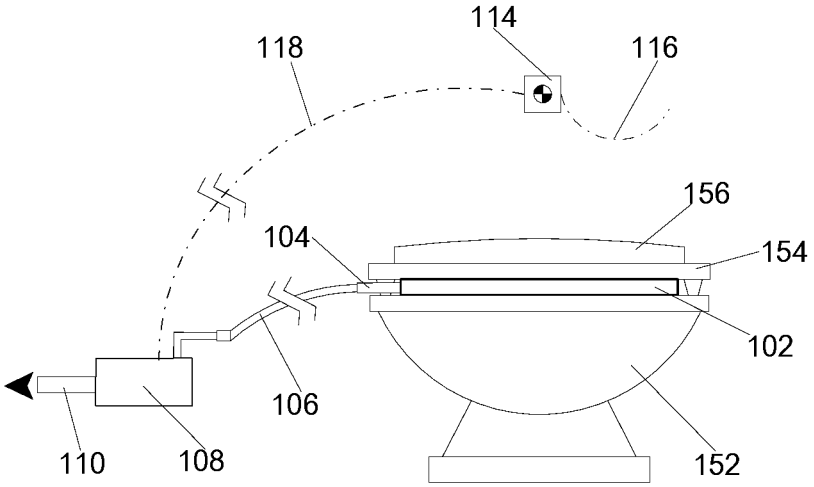
FIG. 5 is a front view of an improved toilet with a toilet seat exhaust system in accordance with this disclosure.
Figure 6:
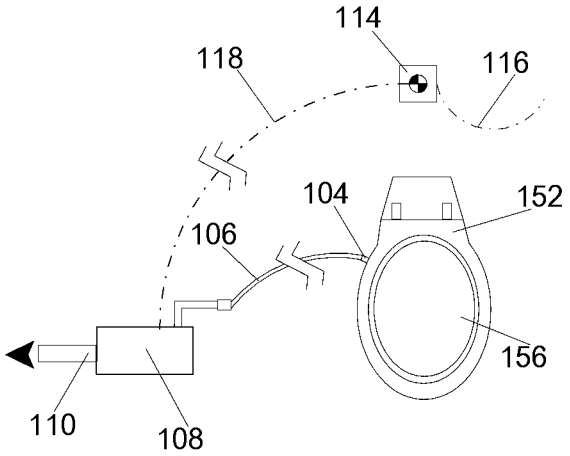
FIG. 6 is a top view of an improved toilet with a toilet seat exhaust system in accordance with this disclosure.

FIG. 2 is a front view of the toilet 100 with the cover 156 and the seat 154 lifted and standing straight up on the base 152. FIG. 5 is a front view of the toilet 100 with the cover 156 and the seat 154 resting flat on the base 152. FIG. 6 is a top view of the toilet 100 with the cover 156 and the seat 154 resting flat on the base 152.

When a user stands in front of or sits on the toilet 100, the motion sensor 114 detects the presence of the user, and triggers the exhaust motor 108. The motor 108 is thus termed herein as an automatic exhaust motor. The motor 108 is powered by connecting to an electricity outlet via a power cable 112. In one implementation, the motor 108 is a 120 CFM (meaning cubic feet per minute) blower operating on a 115 v power supply. The RPM (meaning revolutions per minute) is, for example, 3000. The motor 108 is mounted to a wall of the toilet room. In one implementation, the sensor 114 has a range of three feet.

The motor 108 takes in air and waste gas from the hose 106. Accordingly, air is sucked in through the apertures 304. Waste gas is thus quickly removed through the apertures 304 without spreading out into the whole toilet room. The motor 108 discharges the air, sucked in from the tunnel 102, into the main ventilation outlet, or the outside space of the building hosting the toilet room, through a poly vinyl chloride ("PVC") pipe 110. When the user leaves the toilet room and the toilet 100 is not in use, the sensor 114 turns off (i.e., deactivates) the motor 108. As used herein, the outside space of the building is also referred to as a main ventilation outlet.

Obviously, many additional modifications and variations of the present disclosure are possible in light of the above teachings. Thus, it is to be understood that, within the scope of the appended claims, the disclosure may be practiced otherwise than is specifically described above. For example, the seat 154 is not a closed structure and has an open front. Accordingly, the tunnel 102 is not a closed loop. As an additional example, the toilet exhaust system does not have a sensor. Instead, the motor 108 is manually turned on or off. Such a motor 108 is termed herein as manual exhaust motor. As still further an example, the rate at which motor 108 discharges air is configurable. In other words, at one setting, the motor 108 discharges a bigger volume of air per minute, while it discharges a smaller volume of air per minute at another setting.

The foregoing description of the disclosure has been presented for purposes of illustration and description, and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It is intended that the scope of the disclosure not be limited by the specification, but be defined by the claims set forth below. In addition, although narrow claims may be presented below, it should be recognized that the scope of this invention is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. A toilet comprising:

i) a base;

ii) a seat operatively coupled to the base;

iii) a perforated tunnel extending along the circumference of an inner edge of the seat, wherein the tunnel includes a first channel, a wall surrounding the first channel, and a set of apertures extending through the full thickness of the wall and connecting to the first channel;

iv) a connector channel connected to the first channel;

v) an exhaust motor powered by electricity and connected to the connector channel via an exhaust hose; and vi) a motion sensor connected to the exhaust motor and adapted to turn on the exhaust motor when the toilet is in use and turn off the exhaust motor when the toilet is not in use.

2. The toilet of claim 1 wherein the exhaust motor takes in air from the first channel through the connector channel and the exhaust hose and discharges the air through a pipe.

3. The toilet of claim 1 wherein the exhaust motor is a manual exhaust motor.

4. The toilet of claim 1 wherein the tunnel extends along the full circumference of the inner edge of the seat.

5. The toilet of claim 1 wherein a first subset of the set of apertures is positioned on a side surface of the wall and a second subset of the set of apertures is positioned on a bottom surface of the wall.

6. The toilet of claim 1 wherein the tunnel is a built-in tunnel.

7. The toilet of claim 1 wherein the tunnel is an add-on tunnel.

8. The toilet of claim 1 further comprising a connector extending outward from the seat, wherein the connector channel extends through the connector along the full length of the connector.

9. A toilet seat exhaust system used with a toilet, the toilet having a base and a seat operatively coupled to the base, the toilet seat exhaust system comprising:

i) a perforated tunnel adapted to be affixed to the down side of the seat along the circumference of an inner edge of the seat, wherein the tunnel includes a first channel, a wall surrounding the first channel, and a set of apertures extending through the full thickness of the wall and connecting to the first channel;

ii) a connector having a connector channel that is connected to the first channel;

iii) an exhaust motor powered by electricity and connected to the connector via an exhaust hose; and iv) a motion sensor adapted to turn on the exhaust motor when the toilet is in use.

10. The toilet seat exhaust system of claim 9 wherein the exhaust motor takes in air from the first channel through the connector channel and the exhaust hose and discharges the air through a pipe.

11. The toilet seat exhaust system of claim 9 wherein the exhaust motor is a manual exhaust motor.

12. The toilet seat exhaust system of claim 9 wherein the tunnel extends along the full circumference of the inner edge of the seat.

13. The toilet seat exhaust system of claim 9 wherein a first subset of the set of apertures is positioned on a side surface of the wall and a second subset of the set of apertures is positioned on a bottom surface of the wall.

* * * * *